US005543101A

United States Patent [19]

Rüf et al.

[11] Patent Number: 5,543,101

[45] Date of Patent: Aug. 6, 1996

[54] PROCESS OF MAKING CELLULOSE FIBRES

[75] Inventors: Hartmut Rüf, Vöcklabruck; Markus Eibl, Lambach; Raimund Jurkovic, Lenzing, all of Austria

[73] Assignee: Lenzing Aktiengesellschaft, Austria

[21] Appl. No.: 367,260

[22] PCT Filed: Jul. 8, 1994

[86] PCT No.: PCT/AT94/00087

§ 371 Date: Jan. 4, 1995

§ 102(e) Date: Jan. 4, 1995

[87] PCT Pub. No.: WO95/02082

PCT Pub. Date: Jan. 19, 1995

[30] Foreign Application Priority Data

Jul. 8, 1993 [AT] Austria ..... 1348/93

[51] Int. Cl.[6] ..... D01F 2/02

[52] U.S. Cl. ..... 264/187; 264/211.11; 264/211.16

[58] Field of Search ..... 264/187, 203, 264/210.3, 210.8, 211.11, 211.14, 211.16; 106/163.1, 208; 428/364, 393

[56] References Cited

U.S. PATENT DOCUMENTS 4,246,221 1/1981 McCorsley, III ..... 264/203

4,416,698 11/1983 McCorsley, III ..... 106/163.1

FOREIGN PATENT DOCUMENTS 494851 7/1992 European Pat. Off. .

494852 7/1992 European Pat. Off. .

WO92/07124 4/1992 WIPO .

WO92/14871 9/1992 WIPO .

WO93/19230 9/1993 WIPO .

*Primary Examiner*—Leo B. Tentoni

*Attorney, Agent, or Firm*—Brumbaugh, Graves, Donohue & Raymond

[57] ABSTRACT

Disclosed is a process for producing cellulose fibers having a decreased tendency to fibrillate. The process comprises the steps of extruding a solution of cellulose in a tertiary amine-oxide through spinning holes of a spinneret to form cellulose filaments, conducting the extruded cellulose filaments across an air gap of greater than 30 mm, and introducing the cellulose filaments into a precipitation bath. The process is carried out in a way that the mathematical expression $51.4+0.033\times D+1937\times M^2-7.18\times T-0.094\times L-2.50\times F+0.045\times F^2$, does not exceed the number 10. In the mathematical expression, D is the spinning hole diameter in μm, M is the dope output per hole in g/min, T is the titer of the individual filament in dtex, L is the length of the air gap in mm and F is the humidity of the air in the air gap in g of water/kg of air.

7 Claims, No Drawings

PROCESS OF MAKING CELLULOSE FIBRES

FIELD OF THE INVENTION

The present invention is concerned with cellulose fibres and a process for the production of cellulose fibres by extruding a solution of cellulose in a tertiary amine-oxide through spinning holes of a spinneret and conducting the extruded filaments across an air gap into a precipitation bath while drawing them.

BACKGROUND OF THE INVENTION

As an alternative to the viscose process, in recent years there has been described a number of processes in which cellulose, without forming a derivative, is dissolved in an organic solvent, a combination of an organic solvent and an inorganic salt, or in aqueous saline solutions. Cellulose fibres made from such solutions have received by BISFA (The International Bureau for the Standardisation of man made Fibres) the generic name Lyocell. As Lyocell, BISFA defines a cellulose fibre obtained by a spinning process from an organic solvent. By "organic solvent", BISFA understands a mixture of an organic chemical and water. "Solvent-spinning" is considered to mean dissolving and spinning without the forming of a derivative.

So far, however, only one process for the production of a cellulose fibre of the Lyocell type has achieved industrial-scale realization. In this process, N-methylmorpholine-N-oxide (NMMO) is used as a solvent. Such a process is described for instance in U.S. Pat. No. 4,246,221 and provides fibres which present a high tensile strength, a high wet-modulus and a high loop strength.

However, the usefulness of plane fibre assemblies, for example fabrics, made from the above fibres, is significantly restricted by the pronounced tendency of the fibres to fibrillate when wet. Fibrillation means the breaking up of the fibre in the longitudinal direction at mechanical stress in a wet condition, so that the fibre gets hairy, or furry. A fabric made from these fibres and dyed significantly loses color intensity as it is washed several times. Additionally, light stripes are formed at the abrasion and crease edges. The reason may be that the fibres consist of fibrils which are arranged in the longitudinal direction of the fibre axis and that there is only little crosslinking between these.

WO 92/14871 describes a process for the production of a fibre having a reduced tendency to fibrillation. The reduced tendency to fibrillation is attained by providing all the baths with which the fibre is contacted before the first drying with a maximum pH value of 8.5.

WO 92/07124 also describes a process for the production of a fibre having a reduced tendency to fibrillation, according to which the not dried fibre is treated with a cationic polymer. As such, a polymer with imidazole and azetidine groups is mentioned. Additionally, there may be carried out a treatment with an emulsifiable polymer, such as polyethylene or polyvinylacetate, or a crosslinking with glyoxal.

SUMMARY OF THE INVENTION

In a lecture given by S. Mortimer at the CELLUCON conference in 1993 in Lund, Sweden, it was mentioned that the tendency to fibrillation rises as drawing is increased.

It has been shown that the known cellulose fibres of the Lyocell type still leave something to be desired in terms of tendency to fibrillation, and thus it is the object of the present invention to provide a cellulose fibre of the Lyocell type having a further reduced tendency to fibrillation.

This objective is attained in a process described at the beginning by carrying out the process in a way that the mathematical expression $$51.4+0.33\times D+1937\times M^2-7.18\times T-0.094\times L-2.50\times F+0.045F2$$

wherein D is the spinning hole diameter in μm, M is the dope output per hole in g/min, T is the titer of the individual filament in dtex, L is the length of the air gap in mm and F is the humidity of the air in the air gap in g of water/kg of air, does not exceed the number 10, with the provision that the length of the air gap is provided greater than 30 mm.

The invention is based on the finding that by adjusting the spinning parameters, the structure of the cellulose fibre can be influenced in such a positive way that a fibre having a reduced tendency to fibrillation is formed.

DETAILED DESCRIPTION OF THE PREFERRED EMBODIMENT

A preferred embodiment of the process according to the invention consists in carrying out the process in such a way that the mathematical expression does not exceed the number 5.

The totalling parameters of titer, dope output per spinning hole, length of air gap and humidity in the air gap are interrelated by the above mathematical expression in terms of their effect upon the fibrillation behavior of the fibres, i.e., a modification of a paramenter having a negative effect on fibrillation can be offset by a suitable adjustment of one or more other parameters. Naturally, there will be limits imposed by economic or technical circumstances, e.g., a dope throughput of 0.01 g/hole/min provides excellent conditions for the spinning of a fibre having a reduced tendency to fibrillation, but is inconvenient for economic reasons. Therefore, a dope throughput of from 0.025 to 0.05 g/hole/min is preferred.

It has been further shown that great air gap lengths have a positive effect on the fibrillation behavior, but that with the small hole/hole-distances used in staple fibre spinnerets they lead relatively quickly to the ocurrence of spinning defects. Thus, an air gap length of smaller than 100 mm is preferred.

Referring to the humidity of the air in the air gap, in spinnerets where the spinning holes have a small diameter or in case of the lowest dope throughput, the humidity of the normal room climate will be sufficient, while for higher throughputs or for the easier-to-use spinnerets in the range of from 70 to 130 μm, an air humidity of from 20 to 30 g of water/kg of air is preferred. The temperature in the air gap is chosen so as not to fall below the dew point, i.e., so that no water will condense in the air gap, and that on the other hand there will not arise difficulties in spinning due to too high temperatures. Values between 10° and 60° C. can be adjusted, temperatures between 20° and 40° C. being preferred.

According to the process according to the invention, all known cellulosic dopes can be processed. Thus, these dopes may contain of from 5 to 25% of cellulose. However, cellulose contents of from 10 to 18% are preferred. As a raw material for the production of cellulose, hard or soft wood may be used, and the polymerization degrees of the cellulose(s) may be in the range of the commercial products commonly used in technics. It has been shown, however, that in case of a higher molecular weight of the cellulose, the spinning behavior will be better. The spinning temperature may range, according to the polymerization degree of the cellulose and the solution concentration respectively, of from 75° to 140° C., and may be optimized in a simple way for any cellulose and for any concentration respectively. The draw ratio in the air gap depends, when the titer of the fibres is fixed, on the spinning hole diameter and on the cellulose concentration of the solution. In the range of the preferred cellulose concentration however, there could not be detected any influence of the latter on the fibrillation behavior, as long as one operates within the range of the optimum spinning temperature.

Subsequently, the testing processes and preferred embodiments of the invention will be described in more detail.

Evaluation of fibrillation

The abrasion of the fibres among each other in washing processes and finishing processes in wet condition was simulated by the following test: 8 fibres were put into a 20 ml sample bottle with 4 ml of water and shaken during 3 hours in a laboratory mechanical shaker of the RO-10 type of the company Gerhardt, Bonn (Germany), at stage 12. Afterwards, the fibrillation behaviour of the fibres was evaluated by microscope, by means of counting the number of fibrils per 0.276 mm fibre length.

The fibre tensile strength and fibre elongation at break were tested following the BISFA rule on "Internationally agreed methods for testing viscose, modal, cupro, lyocell, acetat and triacetat staple fibres and tows", edition 1993.

EXAMPLES 1–29

A 12% spinning solution of sulfite-cellulose and sulfate-cellulose (12% water, 76% NNMO) was spun at a temperature of 115° C. As a spinning apparatus, a melt-flow index apparatus commonly employed in plastics processing of the company Davenport was used. This apparatus consists of a heated, temperature-controlled cylinder, into which the dope is filled. By means of a piston, to which a weight is applied, the dope is extruded through the spinneret provided on the bottom of the cylinder. This process is referred to as dry/wet-spinning process, since the extruded filament immerses, once it has passed an air gap, into a spinning bath.

A total of 29 extrusion tests were carried out, varying the diameter of the spinnerets, the dope output, the titer of the extruded filament, the length of the air gap and the humidity. The results are indicated in Table 1. In the column "fibrils", the average number of fibrils on a fibre length of 276 μm is indicated.

TABLE 1

| Example No. | Hole Diameter | Output | Titer | Gap | Humidity | Fibrils |
|---|---|---|---|---|---|---|
| 1 | 130 | 0.014 | 2.16 | 85 | 39 | 4.8 |
| 2 | 130 | 0.014 | 2.13 | 130 | 16 | 0.4 |
| 3 | 130 | 0.015 | 2.37 | 40 | 21 | 0.8 |
| 4 (C) | 130 | 0.041 | 1.23 | 85 | 0 | 38 |
| 5 | 130 | 0.043 | 2.14 | 85 | 21 | 0.4 |
| 6 | 130 | 0.043 | 2.13 | 85 | 20 | 1.6 |
| 7 | 130 | 0.042 | 2.08 | 85 | 20 | 0.3 |
| 8 | 130 | 0.041 | 2.03 | 85 | 20 | 5.4 |
| 9 | 130 | 0.039 | 1.94 | 85 | 19 | 5.0 |
| 10 | 130 | 0.042 | 2.95 | 40 | 19 | 0.8 |
| 11 | 130 | 0.039 | 3.09 | 85 | 40 | 3.5 |
| 12 (C) | 130 | 0.102 | 2.21 | 130 | 21 | 18 |
| 13 (C) | 130 | 0.102 | 2.22 | 85 | 0 | 54 |
| 14 (C) | 130 | 0.100 | 2.23 | 85 | 38 | 22 |
| 15 | 50 | 0.015 | 2.37 | 85 | 18 | 3.2 |
| 16 | 50 | 0.043 | 2.28 | 130 | 18 | 0.0 |
| 17 | 50 | 0.045 | 2.41 | 40 | 20 | 0.6 |
| 18 | 50 | 0.042 | 2.25 | 85 | 40 | 0.0 |
| 19 | 50 | 0.041 | 2.88 | 85 | 18 | 0.0 |

TABLE 1-continued

| Example No. | Hole Diameter | Output | Titer | Gap | Humidity | Fibrils |
|---|---|---|---|---|---|---|
| 20 (C) | 250 | 0.040 | 1.32 | 85 | 20 | 14 |
| 21 | 250 | 0.041 | 2.35 | 130 | 18 | 2.7 |
| 22 (C) | 250 | 0.041 | 2.18 | 40 | 22 | 14 |
| 23 | 250 | 0.040 | 2.93 | 85 | 19 | 0.8 |
| 24 | 200 | 0.017 | 2.00 | 85 | 21 | 0.0 |
| 25 | 200 | 0.041 | 1.30 | 85 | 20 | 8.0 |
| 26 | 200 | 0.041 | 2.17 | 130 | 18 | 0.8 |
| 27 | 200 | 0.040 | 2.14 | 40 | 19 | 10 |
| 28 | 200 | 0.041 | 2.90 | 85 | 20 | 0.6 |
| 29 C | 200 | 0.100 | 2.16 | 85 | 22 | 19 |

In the Table, the diameter of the spinning hole is indicated in μm, the output in g of dope/hole/min, the titer in dtex, the air gap in mm and the humidity in g of $H_2O$/kg of air. The number indicated below "fibrils" is an average from various results. The Examples 4, 12, 13, 14, 20, 22 and 29 are Comparative Examples. All other Examples are according to the invention and total, when the corresponding parameters are put in the empirically found mathematical expression, a number below 10. It can be deduced from the Table that the cellulose fibres according to the invention present significantly fewer fibrils at testing than the comparative fibres.

EXAMPLES 30–41

The Examples were carried out analogously to the Examples 1–29, the parameters being modified as indicated. In the column "fibrils", the average number of fibrils on a fibre length of 276 μm is indicated.

TABLE 2

| Example No. | Hole Diameter | Output | Titer | Gap | Humidity | Fibrils |
|---|---|---|---|---|---|---|
| 30 (C) | 130 | 0.045 | 1.8 | 12 | 5.3 | 27 |
| 31 (C) | 130 | 0.045 | 1.8 | 12 | 4.0 | 43 |
| 32 | 100 | 0.026 | 1.7 | 60 | 23.5 | 2.8 |
| 33 (C) | 100 | 0.025 | 1.7 | 45 | 13.4 | 16 |
| 34 | 100 | 0.025 | 1.7 | 60 | 25.4 | 3.2 |
| 35 (C) | 100 | 0.025 | 1.7 | 30 | 13.3 | 15.1 |
| 36 (C) | 100 | 0.025 | 1.7 | 30 | 12.7 | 19 |
| 37 | 100 | 0.025 | 1.7 | 60 | 24.4 | 1.9 |
| 38 (C) | 100 | 0.049 | 1.7 | 90 | 0.5 | 34 |
| 39 | 100 | 0.049 | 3.2 | 90 | 19.0 | 0 |
| 40 | 100 | 0.041 | 1.8 | 90 | 29.0 | 0.9 |
| 41 | 130 | 0.025 | 1.3 | 90 | 30.0 | 3.2 |

The spinning parameters are indicated in the units specified in Table 1.

The Examples 30, 31, 33, 35, 36 and 38 do not fulfill the mathematical expression used according to the invention and represent Comparative Examples. From the Table it can be deduced that these fibres have an increased number of fibrils (more than 10 fibrils per 276 μm of fibre length).

In Table 3, there are indicated characteristic fibre parameters for the fibres indicated in Table 2.

TABLE 3

| Ex. No. | Fibre tensile strength at break cN/tex | Fibre elongation at break % | Fibre tensile strength wet cN/tex | Fibre elongation wet % |
|---|---|---|---|---|
| 30 (C) | 46.1 | 10.5 | 33.8 | 14.2 |
| 31 (C) | 50 | 11.3 | 41.4 | 14 |
| 32 | 31.9 | 17.7 | 27.5 | 24.5 |
| 33 (C) | 34.3 | 15.2 | 29.1 | 23.5 |

TABLE 3-continued

| Ex. No. | Fibre tensile strength at break cN/tex | Fibre elongation at break % | Fibre tensile strength wet cN/tex | Fibre elongation wet % |
|---|---|---|---|---|
| 34 | 28.8 | 16.5 | 24.5 | 21.8 |
| 35 (C) | 34.1 | 14.8 | 29.3 | 19.8 |
| 36 (C) | 33.3 | 16.3 | 30.5 | 18.8 |
| 37 | 29.4 | 17.2 | 23.9 | 21.3 |
| 38 (C) | 30.4 | 11.8 | 22.5 | 14.3 |
| 39 | 25.6 | 15.6 | 19.5 | 22.5 |
| 40 | 24.6 | 14.8 | 18.2 | 21.4 |
| 41 | 28.5 | 15.8 | 24.2 | 20.9 |

EXAMPLES 42–54

The Examples were carried out analogously to the Examples 1–29, the parameters being modified as indicated. In the column "fibrils" of the subsequent Table 4, the average number of fibrils on a fibre length of 276 μm is indicated.

TABLE 4

| | | Examples 42–54: | | | | |
|---|---|---|---|---|---|---|
| Example No. | Hole diameter | Output | Titer | Gap | Humidity | Fibrils |
| 42 (C) | 100 | 0.025 | 1.7 | 10 | 13 | 18.0 |
| 43 (C) | 100 | 0.025 | 1.7 | 20 | 13 | 14.0 |
| 44 (C) | 100 | 0.025 | 1.7 | 25 | 13 | 9.0 |
| 45 (C) | 100 | 0.025 | 1.7 | 30 | 13 | 6.0 |
| 46 | 100 | 0.025 | 1.7 | 60 | 13 | 5.5 |
| 47 (C) | 100 | 0.025 | 1.7 | 10 | 13 | 19.0 |
| 48 (C) | 100 | 0.025 | 1.7 | 20 | 13 | 9.5 |
| 49 (C) | 100 | 0.025 | 1.7 | 25 | 13 | 3.5 |
| 50 (C) | 100 | 0.025 | 1.7 | 30 | 13 | 1.0 |
| 51 | 100 | 0.025 | 1.7 | 60 | 13 | 1.0 |
| 52 (C) | 100 | 0.025 | 1.7 | 10 | 20 | 14 |
| 53 (C) | 100 | 0.025 | 1.7 | 10 | 20 | 11.0 |
| 54 | 100 | 0.025 | 1.7 | 60 | 20 | 4.0 |

The spinning parameters are indicated in the units specified in Table 1.

Table 4 shows a clear reduction of the number of fibrils, as soon as an air gap of approximately 25–30 mm is exceeded.

We claim:

1. A process for the production of cellulose fibres comprising the steps of:

extruding a solution of cellulose in a tertiary amine-oxide through spinning holes of a spinneret to form cellulose filaments;

conducting the extruded cellulose filaments across an air gap of greater than 30 mm; and introducing the cellulose filaments into a precipitate bath, wherein the process is carried out in a way that the mathematical expression $$51.4+0.033\times D+1937\times M^2-7.18\times T-0.094\times L-2.50\times F+0.045\times F^2$$

does not exceed the number 10, whereby D is the spinning hole diameter in μm, M is the dope output per hole in g/min, T is the titer of the individual filament in dtex, L is the length of the air gap in mm and F is the humidity of the air in the air gap in units of grams of water/kg of air, wherein said cellulose fibres are formed.

2. A process according to claim 1, wherein the process is carried out in a way such that the mathematical expression does not exceed the number 5.

3. A process according to any one of claims 1 or 2, wherein the dope output per hole is between 0.025 and 0.05 g/min.

4. A process according to claim 3, wherein the length of the air gap is smaller than 100 mm.

5. A process according to any one of claims 1 or 2, wherein the spinneret has spinning holes with diameters between 70 and 130 μm, and the humidity of the air in the air gap is 20 to 30 g of water/kg of air.

6. A process according to claim 1, wherein the length of the air gap is smaller than 100 mm.

7. A process according to claim 2, wherein the length of the air gap is smaller than 100 mm.

* * * * *